United States Patent [19]

Davis et al.

[11] Patent Number: 4,799,687

[45] Date of Patent: Jan. 24, 1989

[54] PROJECTED IMAGE TAG GAME

[76] Inventors: Dennis W. Davis; Russell D. Davis, both of 10740 Eland St., Boca Raton, Fla. 33433

[21] Appl. No.: 16,012

[22] Filed: Feb. 18, 1987

[51] Int. Cl.[4] ..... A63B 67/00; F41J 9/14

[52] U.S. Cl. ..... 273/312; 273/358; 273/1 GA

[58] Field of Search ..... 273/310, 311, 312, 358; 446/219

[56] References Cited

U.S. PATENT DOCUMENTS 4,322,080 3/1982 Pennington ..... 273/311

4,349,337 9/1982 Pardes ..... 273/310

*Primary Examiner*—Richard C. Pinkham

*Assistant Examiner*—Benjamin Layno

[57] ABSTRACT

A light projection tag game requires the overlap of player projected images on a gaming surface. Each player is provided with an optical transceiver which has a receiver with a narrow field of view that is geometrically coincident with the light beam projected from the transceiver. Each player's transceiver can detect when an opponent's image which is also projected on the gaming surface enters this field of view thereby achieving a tag. Receiver methods use either signal transients or infrared modulation. Various embodiments include automatic targets, automatic game control and projected gaming mazes.

5 Claims, 8 Drawing Sheets

PROJECTED IMAGE TAG GAME

BACKGROUND OF THE INVENTION

1. Field of the Invention

This invention lies in the field of amusement games and, more particularly, in the area of tag games involving the use of projected light. Players of this game project visible images on a gaming surface and seek to "tag" each others' projected image by causing the images to overlap.

2. Description of the Prior Art

To date there exist numerous examples of games which project light at targets. The advent of such games brought about simulated tests of marksmanship at the early game arcades. The prior art discloses games which project light at a moving or stationary physical target wherein the target includes either an optical detector or means to reflect the projected light back to the projection device for detection. Two games cited make use of projected light images as targets but do not achieve the goals of the presently disclosed game.

Games which project light pulses at physical targets which have photodetectors include U.S. Pat. Nos. 2,309,614, 2,404,653, and 2,710,754; these make use of a single light gun. U.S. Pat. Nos. 2,629,598, 4,192,507, and 4,232,865 have provision for multiple guns with a single target. U.S. Pat. Nos. 4,192,722 and 4,545,583 equip each opponent with a target and gun.

U.S. Pat. No. 3,655,192 is a single gun game which uses a passive, reflective target for hit detection by the gun. Recently, Worlds of Wonder has produced the game, LAZER TAG TM, which provides each player with an infrared light-emitting pistol and a vest. The vest carries an infrared light sensor worn on the chest to detect and annunciate a hit by an opponent. U.S. Pat. No. 4,322,080 is an image-projecting amusement device which includes a target in the form of the stationary image of a racetrack or obstacle course projected on a screen. The image of a moving object under player control is projected on the target racetrack image. The moving object projector controlled by the player has an optical receiver mounted with it which images the projected object as it is being projected on the racetrack-/obstacle course. This receiver can sense changes in light level reflected from the screen at the position of the projected object indicative of violation of the track boundary or encounter of an obstacle. This game does not allow players to compete via the independent projection of images.

Ideal Toy Corporation marketed a game entitled ELECTRONIC 2-MAN SKEET TM which made use of a projector unit to create a moving target image on a wall. Players used rifles containing narrow field of view optical receivers which when appropriately aimed at the target image would detect it and score a hit. Although this game does allow scoring competition between players, the immediate opponent is constrained to be an automatic target. The game allows only two players and unlike the present invention, the players do not project visible images. Such images provide the visual feedback necessary if a player chooses not to aim along his line of sight or if he is chasing an extremely dynamic target image which requires coordination of wide field vision with wrist action. Nitendo Incorporated has introduced the Nitendo Entertainment System which uses a single gun incorporating an optical receiver to detect target images produced on a television screen. These images are generated by video game cartridges which are played on a console connected to the television. Again, this game does not make use of player-projected images and confines the playing space to that of the television screen.

Pertinent areas of classification for the present invention are believed to comprise U.S. Class 273, Subclasses 310, 311, 312, 358, and U.S. Class 446, Subclasses 175 and 219.

That art which is known to the inventors does not include a tag game wherein players independently project visible images onto a gaming surface with the goal of causing their overlap or superposition and wherein such overlap is detected as a tag by the game hardware.

SUMMARY OF INVENTION

This invention provides a light tag game of the type described initially. The game devices project visible images which make possible player aim improvement and the high speed game action associated with video arcades but with little playing space limitation. The portability of the game allows it to be played indoors or outside. The game devices can automatically annunciate and score game points.

According to one of two chief device embodiments for the present invention players each use a handheld optical transceiver which has a narrow receiver field of view that is coincident with the field of visible light which the transceiver projects to form an image on a gaming surface. Detection of fluctuation in the visible light in this field of view indicates an opponent image has overlapped the initial image (i.e., a tag has occurred). The use of this approach requires only that the gaming surface be relatively flat and uniform in color.

A second embodiment includes in each transceiver a source of infrared light modulated at a frequency characteristic of that unit which is projected along the same path as the visible light. In lieu of a visible light detector, the receiver portion of the transceiver uses an infrared detector with tone decoders to detect frequencies of opponent infrared light images which may enter the field of view of the receiver.

A basic feature of this embodiment is robust operation on any non-specular gaming surface (irregular or flat) in the presence of room lighting and other noise sources.

Further embodiments of the game device are subsidiary to the tag detection means and involve variations in the optical component geometry within the transceiver. In another embodiment of the game, means are provided for projecting automatic targets. This is accomplished by a transceiver which has an electrically or mechanically controlled beam steering mirror. The control of this mirror induces random translation of target image and/or images across the playing surface. These images may be caused to blink on and off as well.

A gaming maze embodiment makes use of a transceiver which can project target images in the form of mazes. A slide projector version would use any of a large number of maze slides. The objective of this game version would be time limited transit or chase of an opponent through the maze without player image overlap with the maze boundaries.

The aforementioned use of infrared signal decoders in each transceiver also makes possible a game embodiment wherein a master game control transmitter communicates game controls to each transceiver via wide area coverage infrared light. It is also considered that the transceivers may likewise communicate with the game control or other transceivers.

The most basic version of this game invention would use small handheld flashlight units with contained scoring means. With only incremental cost the more elaborate embodiments can add automated targets or microprocessor control to the game.

Versions of this invention are explained in detail below with reference to the figures.

DETAILED DESCRIPTION OF THE INVENTION

Figure 1:
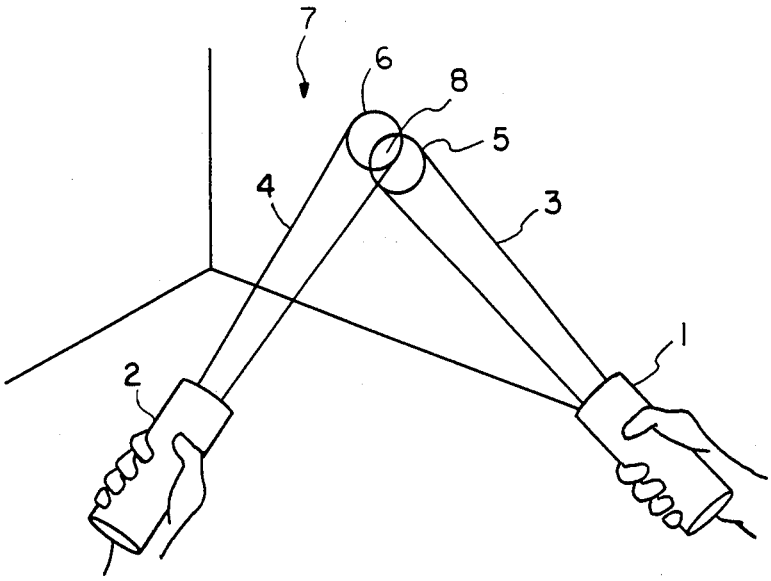
FIG. 1 is a pictorial diagram of the general game concept.

Referring to FIG. 1, an illustration of the light tag game depicts the general concept. Optical transceivers 1 and 2 nominally a few inches in diameter and several inches long are held by each player. Each transceiver projects light along its respective beam path 3 or 4 to form a focused image 5 or 6 on the distant gaming surface 7. The transceivers are capable of detecting image overlap 8 which constitutes a "tag." The light from each player's transceiver could be a different color or form a different shape image for ease of distinguishing the identity of projected images.

Figure 2:
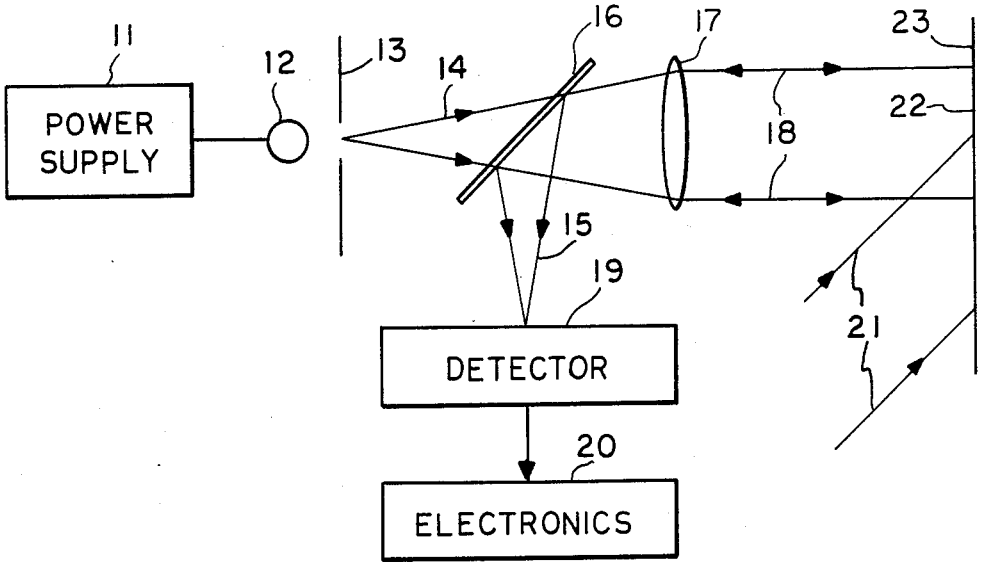
FIG. 2 is an embodiment of the game transceiver which uses a beamsplitter to separate transmitted and received energy paths.

The optical transceiver can be reduced to practice in either of two major embodiments. The first of these exploits detection of changes in visible light signals; a second approach involves auxiliary projection and detection of modulated infrared light with the projected visible light serving solely as a visual cue for players. FIGS. 2, 3, 4, and 5 portray the various transceiver geometries that may be used with the aforementioned approaches. FIG. 2 depicts a transceiver in which a beamsplitter separates transmit and receive functions. The power supply 11 energizes the illuminating light source 12 which projects light through an aperture 13 which shapes the projected light 14. This projected light passes through the beamsplitter 16 and is focused by a lens 17 to form an image 22 on a distant diffuse reflecting surface 23. Light 21 from an opponent transceiver which reflects from the surface 23 and falls within the field of view 18 of the depicted transceiver will travel back through the lens 17 and will be partially reflected from beamsplitter 16 along an optical path 15 to the receiver detector 19. The detector provides signals to the processing electronics 20 which sets the threshold for detecting light from an opponent's transceiver within its field of view (thereby constituting a tag). The electronics 20 will reject signals due to light source 12 and will annunciate a tag by audio-visual output.

Figure 3:
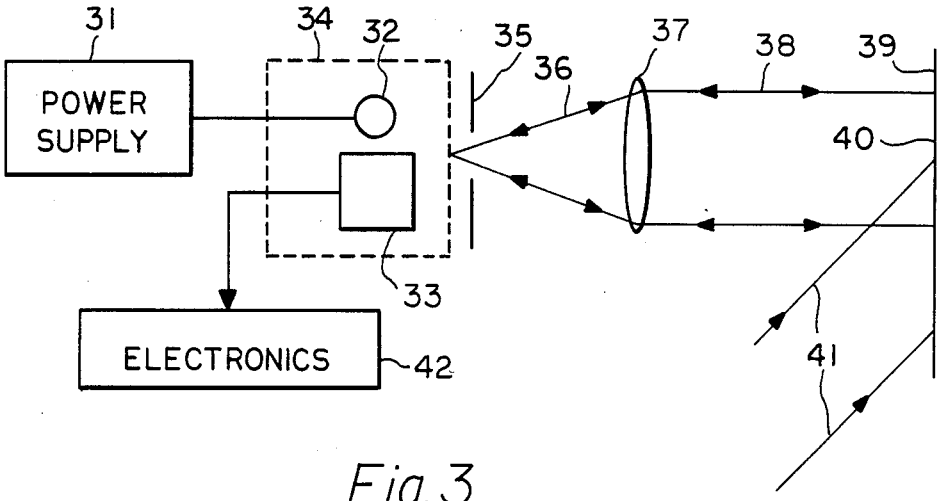
FIG. 3 is a transceiver geometry which collocates the transmitter and detector.

FIG. 3 provides a geometry whereby the transmitting light and detector are essentially collocated. a power supply 31 energizes a light source 32 which projects light through shaping aperture 35 along path 36 through a focusing lens 37 which creates an image 40 on a distant surface 39. The light 41 from an opponent transceiver within the system field of view will travel along path 38, through lens 37, via path 36 to the detector 33 which is collocated with the light source 32 in a common assembly 34. The detected light signal is fed to processing electronics 42 which will score and annunciate a tag.

Figure 4:
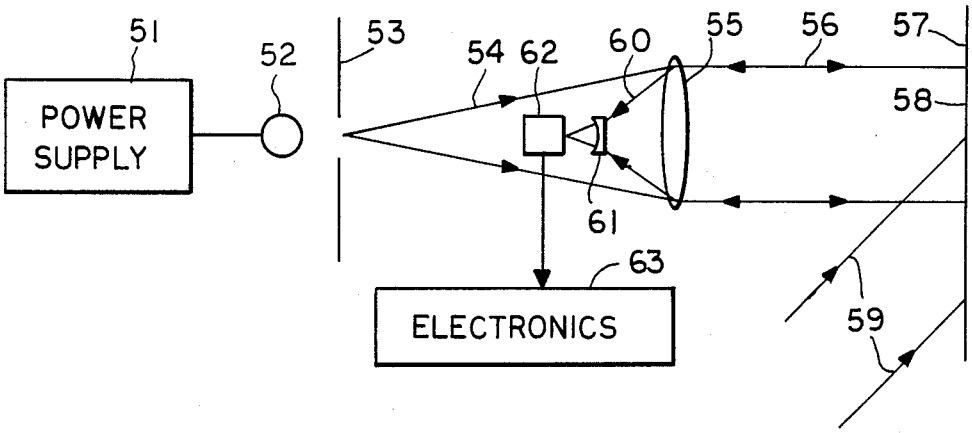
FIG. 4 is a transceiver geometry which allows the transmitter and detector to be located coaxially on a single optical axis.

A coaxial arrangement of transmitter light and detector is shown in FIG. 4. A power supply 51 energizes light source 52 which projects light through shaping aperture 53 along path 54 through focusing lens 55. The resulting focused image 58 appears on the distance surface 57. Opponent light 59 within the field of view travels back along path 56 through lens 55. A portion of this received light is collected by a small lens 61 for focus on detector 62. Received signals are then processed by the electronics 63. The sizes of the detector 62 and lens 61 are small enough to avoid significant obscuration of the projected beam path 54.

Figure 5:
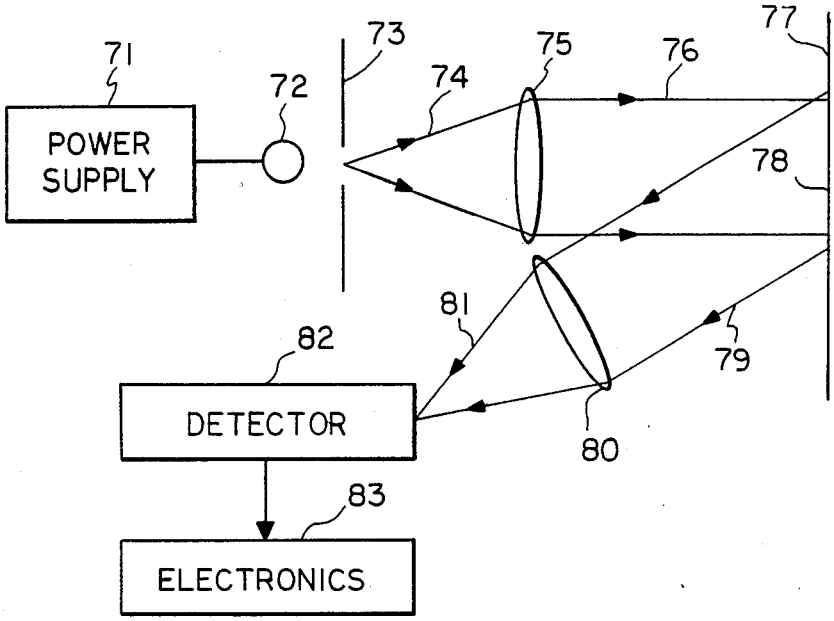
FIG. 5 is a transceiver geometry which places the detector and transmitter on separate optical axes that intersect at the target plane.

Total separation of the transmit and receive beampaths is the distinction of FIG. 5. The power supply 71 energizes light source 72 which projects light through shaping aperture 73 along path 74 through transmit lens 75. This lens projects thee light along path 76 to create a focused image 78 at surface 77. The receiver can image opponent light on this region of the surface by accepting light along path 79 through receiver lens 80. The receiver light is brought along path 81 to the detector 82 which delivers detection signals to processing and annunciation electronics 83.

Figure 6:
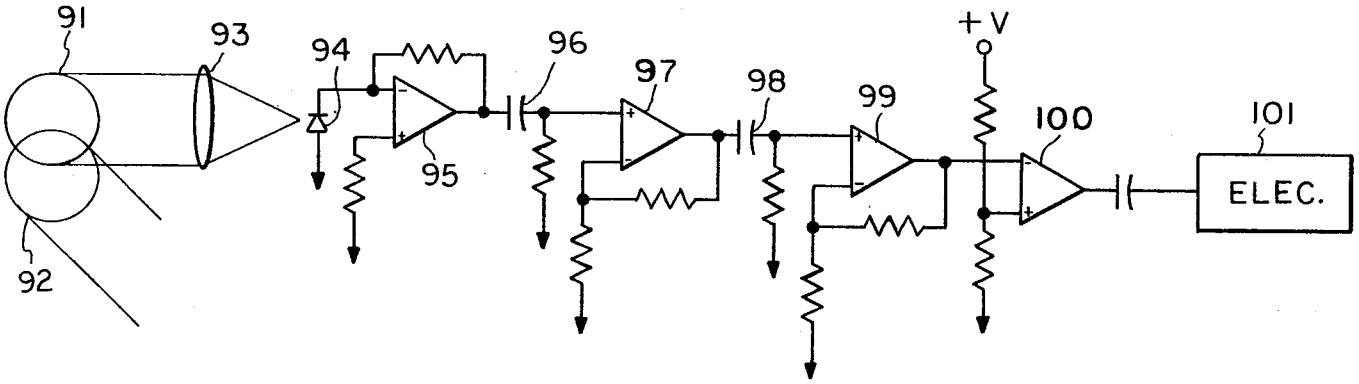
FIG. 6 is an electronic schematic of a receiver circuit which detects a target image by variation of light intensity in the receiver aperture.

An optical detection technique which requires sensing changes in the visible light level within the receiver field of view is explained with reference to the receiver schematic of FIG. 6. An opponent's projected image 92 is shown entering the receiver field of view 91 on the gaming surface. Light from the opponent image is focused by lens 93 on a photodiode 94 as is light from the projected image of the transmitter (not shown) associated with their receiver. The detected signals are amplified by amplifiers 95, 97, and 99 but are AC-coupled through capacitors 96 and 98 so that only transient or time-varying signals can be passed. In this way the constant signal due to the light transmitted by a given device will be rejected by its own receiver and the transient signal due to an opponent image transiting the receiver field of view will be detected. A threshold for such detection is established by the voltage comparator 100. The digital output of the comparator which is indicative of a tag feeds the annunciation and scoring electronics 101.

Figure 7:
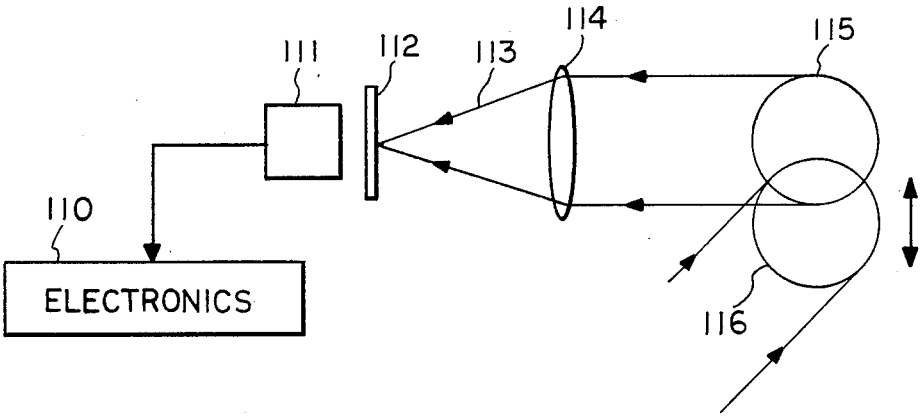
FIG. 7 is an embodiment of the receiver portion of a game transceiver which detects target images on the basis of color.

A variation of this detection approach is shown in FIG. 7. An opponent image 116 of a particular color different than that associated with the depicted transceiver is shown traversing the receiver field of view 115. The opponent light is imaged by lens 114 and focused along path 113 through a color filter 112 which admits only the opponent coloration of light to detector 111. The detector feeds signals to processing electronics 110.

Figure 8A:
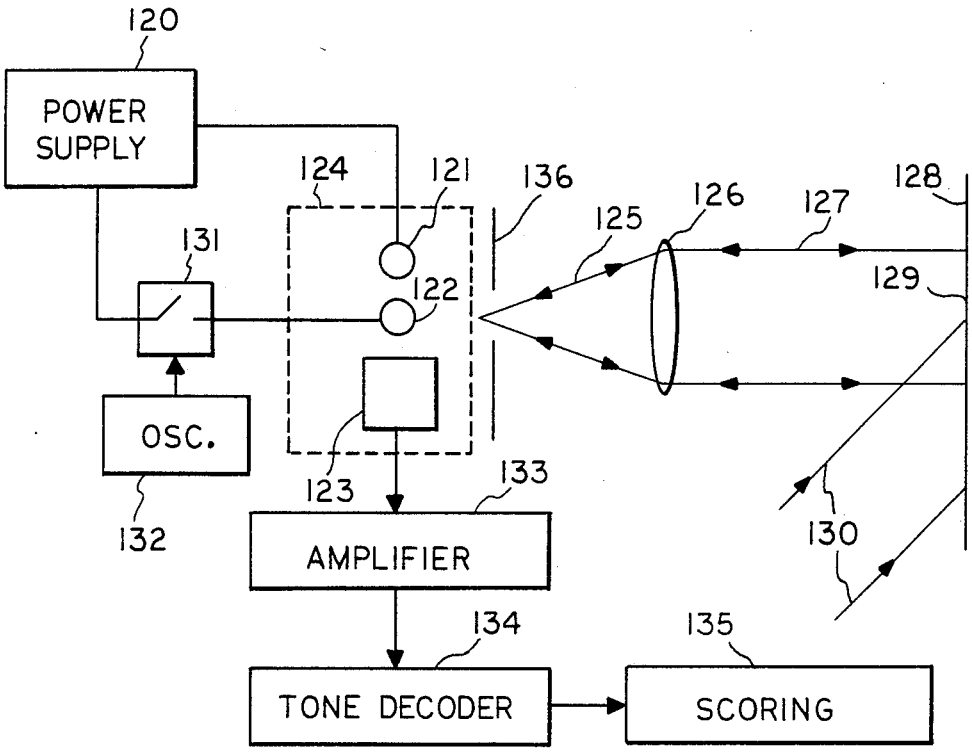
FIG. 8A is an embodiment of the transceiver which projects and detects modulated infrared light.

An alternate optical detection technique is shown in FIG. 8A. A visible light source 121, an infrared light source 122, and an infrared detector 123 are shown collocated in assembly 124. A power supply 120 continuously energizes the visible light source 121. An oscillator 132 operating at a fixed frequency modulates the intensity of an infrared light-emitting diode by toggling a voltage-controlled switch 131 connecting the diode 122 to power 120. The continuous visible and modulated infrared light are both projected through shaping aperture 136 along path 125 through focusing lens 126 to form both a visible and infrared image 129 on surface 128. The corresponding visible and infrared light from an opponent 130 which is in the receiver field of view will traverse path 127 through lens 126 and be focused on the infrared detector 123. The opponent infrared light will be modulated at a frequency different from oscillator 132 but a frequency which will be detected by the tone decoder 134 subsequent to passage through amplifier 133. Scoring electronics 135 will annunciate a tag.

Figure 8B:
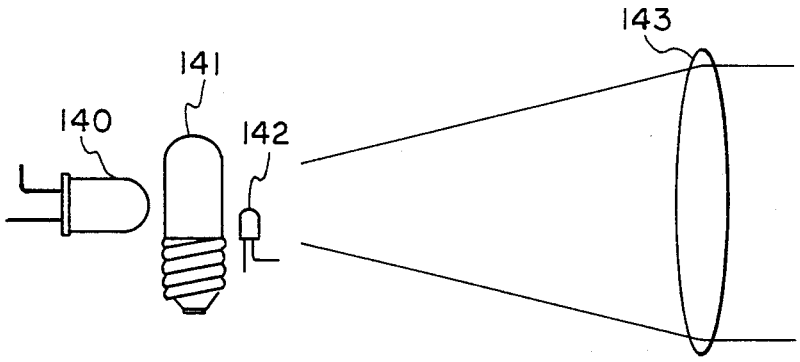
FIG. 8B is a depiction of the placement geometry of the transmission and detection elements for the transceiver version which uses infrared light.

FIG. 8B shows a geometry for collocating the infrared diode 140, visible light 141, and infrared detector 142 for use with a common lens 143.

Figures 9A, 9B:
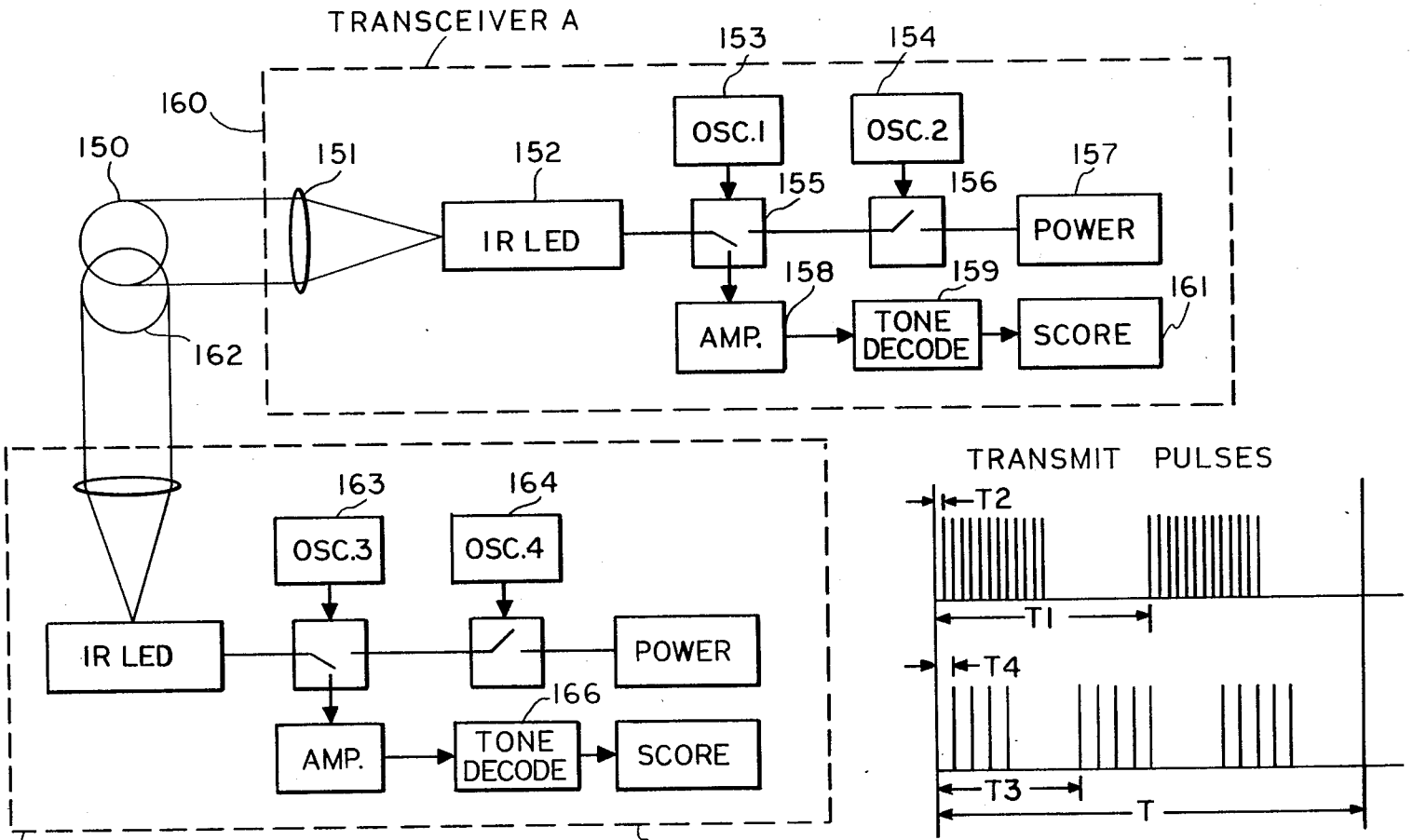
FIG. 9A is a schematic of a transceiver embodiment which uses a single infrared light-emitting diode as both a transmitter and detector of light.
FIG. 9B is a waveform diagram which details the timing of modulation applied to the infrared diodes.

The use of a single infrared diode to provide both transmit and receive functions is shown in FIG. 9A. Transceiver A, 160, and transceiver B, 165, are shown with overlapping fields of view 150 and 162. The visible light sources are not depicted. Discussion of function of the infrared system is directed to transceiver A, 160. Infrared light is both projected from and received through lens 151. Oscillator 1, 153, causes the infrared diode to toggle between transmit and detection modes of operation by alternating its switch connection 155 to transmit power or receiver amplification. Oscillator 2, 154, serves to amplitude modulate the infrared diode via the voltage-controlled switch 156 connection to the power 157 when switch 155 is in the transmit position. When switch 155 is in the receive or detection position, the received modulated signal is boosted in amplifier 158 and detected in the tone decoder 159. Annunciation and scoring occur in the score electronics 161. Tone decoder 159 in transceiver A, 160, will detect the frequency of oscillator 4, 164, in transceiver B, 165, and the complimentary decoder 166 of transceiver B, 165, will detect the frequency of oscillator 2, 154, of transceiver A, 160.

FIG. 9B provides a timing diagram for oscillators 153, 154, 163, and 164. Periods T1, T2, T3, and T4 are the waveform periods associated with oscillators 153, 154, 163, and 164, and respectively. Period T represents the minimum image encounter time associated with a tag. The relative duration of the these periods is chosen to insure tag detection within the alloted receive mode time windows (during portions of the waveforms where transmit pulses are absent).

Figure 10:
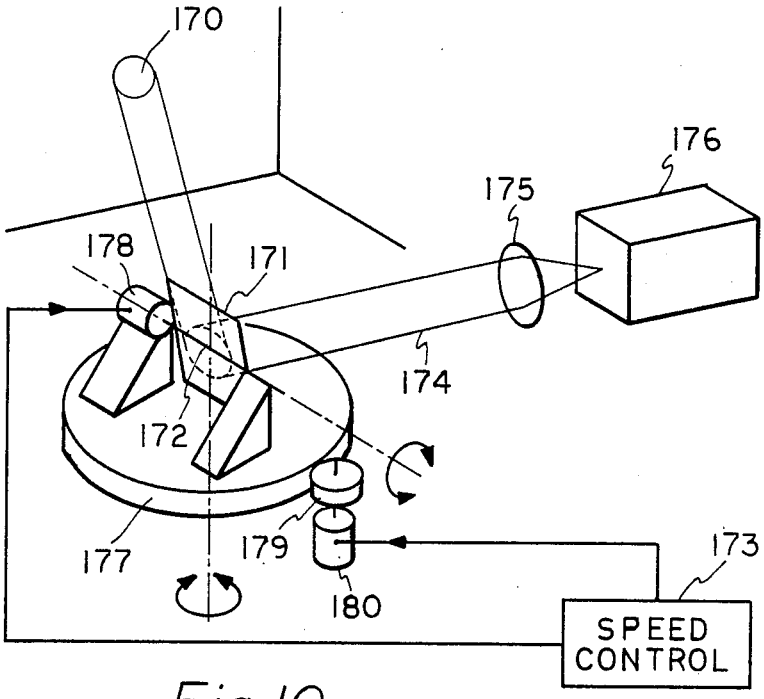
FIG. 10 is a pictorial diagram of an implementation of an automatic target generator.

FIG. 10 shows an automatic target generator. One of the aforementioned transceivers 176 can project and receive light through focusing lens 175. The optical path 174 introduces the light to a tilt mirror 171 which is caused to rotate about a horizontal axis mount 172 by motor 178. Motor 180 via drive wheel 179 and platform 177 causes the mirror 171 to also rotate about its vertical axis. The trajectory of the image 170 which is reflected from the mirror 171 to a distant surface is determined by the speed controls 173 for both motors.

Figure 11:
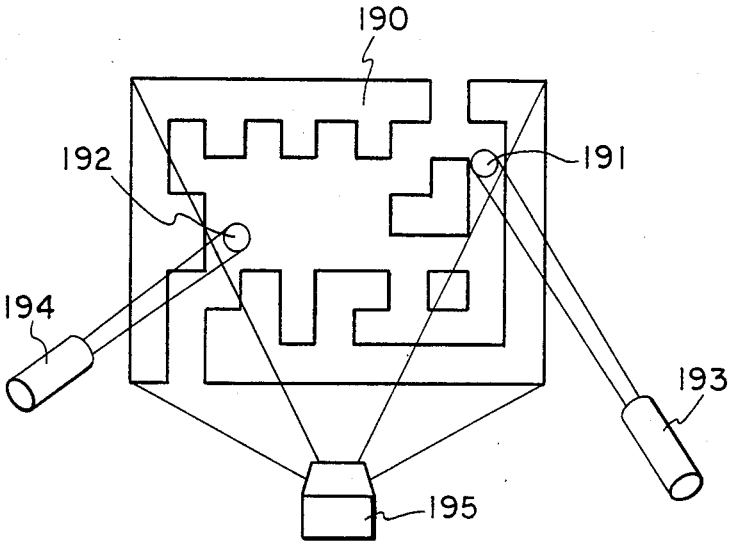
FIG. 11 is a pictorial diagram of a maze projection version of the game.

A maze projection device is shown in FIG. 11. A maze image 190 is projected on a gaming surface by projector 19. Transceivers 193, 194 have means of detecting when their projected images 191, 192 have violated maze boundaries. Characteristic infrared modulation associated with the maze image could be used to detect such boundary violation.

Figure 12:
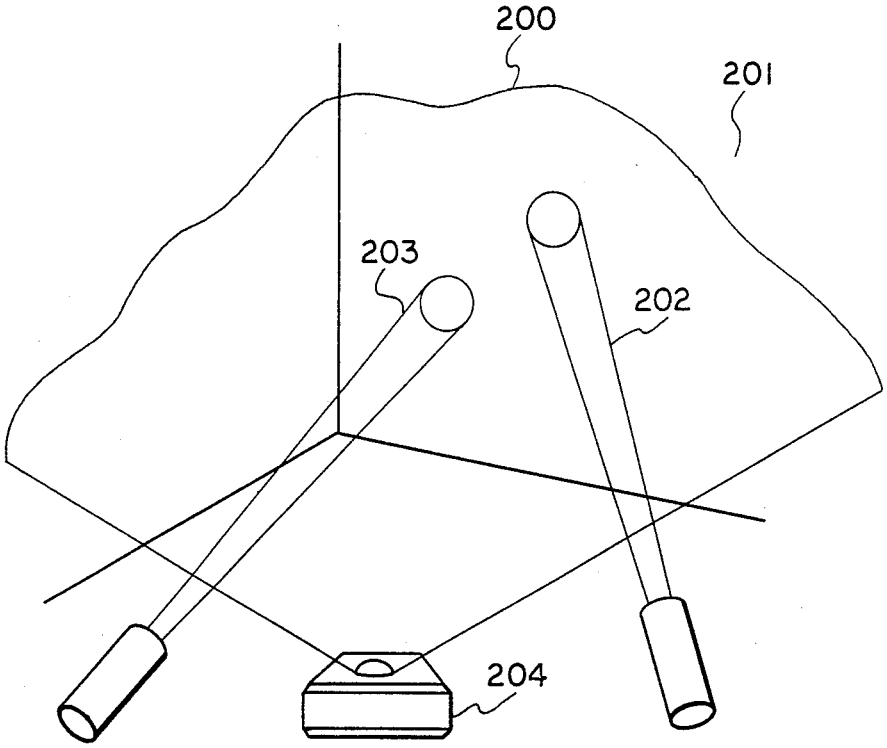
FIG. 12 is a pictorial diagram of a version of the game which allows master game control signals to be transmitted to each transceiver via infrared light.

FIG. 12 depicts a master game control unit 204 which floods the gaming surface 201 with infrared light 200 which is modulated with game control information. This light 200 will always be within the transceiver fields of view 202, 203, and can be detected in order to alter transceiver characteristics.

What is claimed is:

1. A light projection tag game wherein players may attempt to accomplish a tag by causing the superposition of projected images on a gaming surface, said game comprising optical transceiver means for projecting said images onto said gaming surface and detecting said image light reflected from said gaming surface so as to sense superposition of said images, whereby said images are projected from multiple locations and caused to move in pursuit action across said gaming surface, said transceiver comprising:

a. A light-emitting device which projects a beam of light along a first optical axis;

b. a lens with focusing means incident to said beam for projecting an image on a distant surface along said first optical axis;

c. a lens and detector assembly located along a second optical axis for detecting light reflected from said distant surface, wherein said assembly has angular adjustment means for causing said second optical axis to intersect said first optical axis at the location of said projected image, said assembly having field of view adjustment means that allows said detector to receive light only from area of said projected image on said gaming surface;

d. electronic means for processing electronic signals resulting from optical detection of said received light and producing output indicative of said tag;

wherein said projected image can be caused to move across said gaming surface by manual pointing of said transceiver by said player, wherein said light-emitting device is an assembly emitting visible light and modulated infrared light, said modulated infrared light having modulation characteristic of particular said transceiver, said detector comprising an infrared detector, said processing means responsive to said modulation characteristic of an opponent transceiver, said modulated infrared light source and said infrared detector functions provided by a single lightemitting diode, said light-emitting diode having electronic means for alternating connection to transmitter power and to said detector processing means.

2. A game as claimed in claim 1, wherein said transceiver has game scoring and display means.

3. A game as claimed in claim 2, wherein said transceiver has electronic timing means to establish encounter times for said tag and game duration.

4. A game as claimed in claim 3, which includes a separate infrared game control transceiver which floods said gaming surface with modulated infrared light, said modulated light containing game control information, said detector processing means within said player transceivers having decoding means for intercepting said control information and using said information to alter play of said game, said player transceivers having provision for communicating with said game control transceiver.

5. A game as claimed in claim 3, wherein said transceivers include wide area of coverage means for communicating infrared game control information among said transceivers.

* * * * *